US005094091A

United States Patent [19]

Treuz et al.

[11] Patent Number: 5,094,091

[45] Date of Patent: Mar. 10, 1992

[54] STAMPED KNITTING TOOL FOR TEXTILE MACHINES

[75] Inventors: Gerhard Treuz, Bitz; Wolfgang Schmoll, Haigerloch-Owingen, both of Fed. Rep. of Germany

[73] Assignee: Theodor Groz & Söhne & Ernst Beckert, Albstadt-Ebingen, Fed. Rep. of Germany

[21] Appl. No.: 610,946

[22] Filed: Nov. 9, 1990

[30] Foreign Application Priority Data

Nov. 10, 1989 [DE] Fed. Rep. of Germany ... 8913293[U]

[51] Int. Cl.[5] ..... D04B 35/04

[52] U.S. Cl. ..... 66/123

[58] Field of Search ..... 66/121, 123, 134

[56] References Cited

U.S. PATENT DOCUMENTS

| | | | |
|---|---|---|---|
| 938,795 | 11/1909 | Scott | 66/121 |
| 1,681,512 | 8/1928 | Beyer | 66/123 X |
| 1,692,220 | 11/1928 | Osberg | 66/121 X |
| 4,452,053 | 6/1984 | Egbers et al. | 66/123 |
| 4,553,411 | 11/1985 | Schuler et al. | 66/123 |
| 4,562,705 | 1/1986 | Berentzen | 66/121 |
| 4,783,976 | 11/1988 | Sos | 66/121 |

FOREIGN PATENT DOCUMENTS

| | | | |
|---|---|---|---|
| 2553547 | 6/1976 | Fed. Rep. of Germany . | |
| 2820925 | 11/1979 | Fed. Rep. of Germany . | |
| 3014751 | 10/1981 | Fed. Rep. of Germany . | |
| 3314809 | 10/1984 | Fed. Rep. of Germany | 66/123 |
| 3336212 | 1/1985 | Fed. Rep. of Germany | 66/124 |
| 3706856 | 3/1988 | Fed. Rep. of Germany . | |
| 2010367 | 6/1983 | German Democratic Rep. | 66/121 |

*Primary Examiner*—Werner H. Schroeder
*Assistant Examiner*—John J. Calvert
*Attorney, Agent, or Firm*—Spencer & Frank

[57] ABSTRACT

A knitting tool for textile machines has a shank which, beginning at its upper and/or lower edge, is provided in at least some regions with a slot-like recess extending in the longitudinal direction of the shank and forming a hollow space that is filled with vibration damping plastic material.

5 Claims, 2 Drawing Sheets

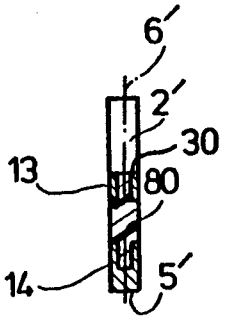
Fig. 6
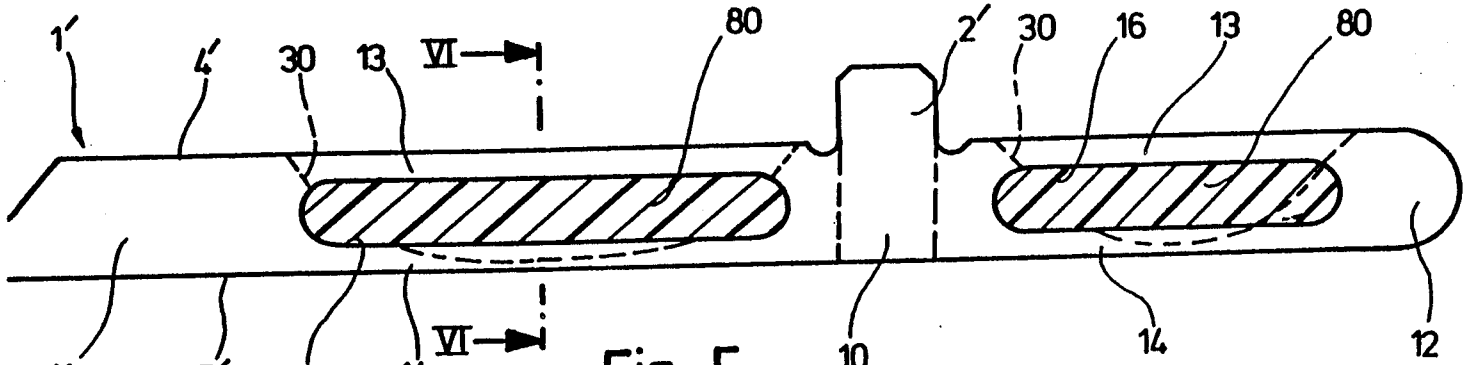
Fig. 5
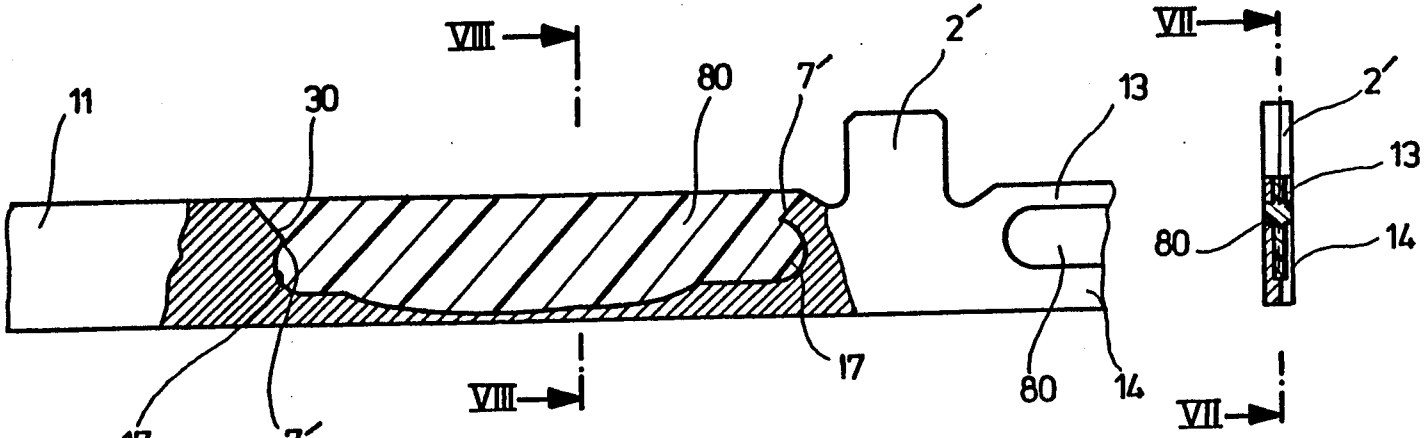
Fig. 8
Fig. 7

STAMPED KNITTING TOOL FOR TEXTILE MACHINES

CROSS REFERENCE TO RELATED APPLICATION(S)

This application claims the priority of application Serial Number G89 13 293.9, filed on Nov. 10th, 1989 in the Federal Republic of Germany, the subject matter of which is incorporated herein by reference.

BACKGROUND OF THE INVENTION

1. Field of the Invention

The present invention relates to a stamped knitting tool for textile machines, particularly knitting machines, including a shank which is provided with at least one butt and has at least one hollow space filled with a vibration damping material (such as plastic) firmly bonded to the shank.

2. Background Information

Knitting tools are here understood to mean latch needles, spring beard needles, compound needles, latchless needles, sinkers and the like.

In order to avoid hook or head breakage which occurs with increasing frequency at higher knitting speeds or to at least reduce the frequency of breakage and thus extend the service life of the knitting tools, German Patent No. 2,820,925, and corresponding U.S. Pat. No. 4,452,053, disclose the provision of at least one easily flexible bridge piece which is provided in the shank and which is coupled to the butt to thus convert the impact energy introduced into the butt by the cams of the machine into bending work. This narrow bridge piece has a height of at most 1.1 mm and, with a length of, for example, more than 8 mm, is therefore highly elastic. In order to increase the stability of such knitting tools equipped with a greatly vibration damped shank, German Offenlegungsschrift (application published without examination) 3,014,751, and corresponding U.S. Pat. No. 4,553,411, disclose the provision of a further, slightly flexible bridge piece or rib which is coupled to the butt and which, together with the above-mentioned upper bridge piece and with continuous guide members extending from the upper shank edge to the lower shank edge, defines at least one hollow space. All of these knitting tools have been found to be excellent in practice.

German Patent No. 3,314,809, and corresponding U.S. Pat. No. 4,562,705, disclose a modification of these knitting tools in that the shank is provided with at least one hollow space, which is closed or open at its edges and is filled with a vibration damping material (plastic) which is firmly bonded to the adjoining shank. These hollow spaces are openings or recesses which are oriented transversely to the longitudinal axis of the shank and may possibly have a profiled shape along their edges to thus ensure a firm anchor for the vibration damping material (plastic) filling. It has been found that the combination of the filling material (plastic) and the easily flexible bridge pieces which have a height of no more than 1.1 mm, favorably influences the vibration behavior of the bridge pieces in such a manner that it is possible to further increase the knitting speed while simultaneously extending the service life of the knitting tools.

In view of the openings or recesses extending from broadside to broadside of the shank and forming the respective hollow space, the anchoring of the vibration damping material (plastic) which fills the respective hollow spac can be effected only at the outlining faces of the respective hollow space. Due to the small thickness of the shank, these faces are necessarily narrow. This problem can be solved technically, but it may require special measures with respect to the edge configuration (see, for example, German Patent No. 3,706,856 and corresponding U.S. Pat. No. 4,783,976).

SUMMARY OF THE INVENTION

Based on this prior art, it is an object of the present invention to improve a knitting tool of the above-mentioned type, which is suitable for high knitting speeds, so that it provides simpler means for anchoring the vibration damping material (plastic) filling the hollow space in the shank, while maintaining the described advantageous characteristics when used in mass production.

To solve this problem, the knitting tool according to the invention is characterized in that the shank, starting from its upper and/or lower edge, is provided in its longitudinal direction, at least in some regions, with at least one slot-like recess which constitutes the hollow space filled with vibration damping material (plastic).

The vibration damping material (plastic) is supported in the slot-like recess on all sides so that excellent anchoring to the metal shank is ensured without difficulty. The recesses forming the hollow spaces can be made without difficulty by means of correspondingly configured slot cutters or keyway cutters. In a knitting tool having a solid shank, the recess is defined on both sides by relatively thin cheeks which elastically hold the knitting tool. This, in connection with the vibration damping material (plastic) filling the recess, improves the above-mentioned advantageous characteristics. Low frequency of hook or head breakage and long service life at high knitting speeds are maintained or even improved.

Advantageously, the shank may be provided with at least one continuous hollow space which extends, at least in some regions, from the upper shank edge to the lower shank edge and includes, for example, a projecting or recessed region on at least one side so that the vibration damping material (plastic) is additionally anchored in a form locking manner. Pressing the vibration damping material (plastic) into such a continuous slot-like recess is also particularly simple. However, in principle, embodiments are also contemplated in which the shank has at least one hollow space that is closed at the bottom and is simply filled with the vibration damping material (plastic) from an opening at the upper or lower shank edge.

In a knitting tool whose shank is provided with at least two guide members which are continuous from the upper shank edge to the lower shank edge and are connected with one another by means of narrow bridge pieces, thus defining, together with the guide members, a hollow space filled with vibration damping material (plastic), the arrangement according to the invention is such that a slot-like recess of the described type is disposed in the region of at least one bridge piece whose thus formed hollow space is also filled with vibration damping material (plastic).

The height of the bridge piece is a function of the shank dimensions in view of the damped vibration behavior to be realized; however, in the preferred embodiments, it is no more than 1.1 mm.

BRIEF DESCRIPTION OF THE DRAWINGS

FIG. 5 is a sectional side view of a knitting tool according to the invention including another embodiment of the shank and bridge pieces coupled to the control butt.

FIG. 6 is a sectional view of the knitting tool of FIG. 5, seen along line VI—VI of FIG. 5.

FIG. 7 is a side view, partially broken open of the knitting tool of FIG. 5 seen along line VII—VII of FIG. 8.

FIG. 8 is a sectional view of the knitting tool of FIG. 7, seen along line VIII—VIII of FIG. 7.

DETAILED DESCRIPTION OF THE PREFERRED EMBODIMENTS

Figure 1:
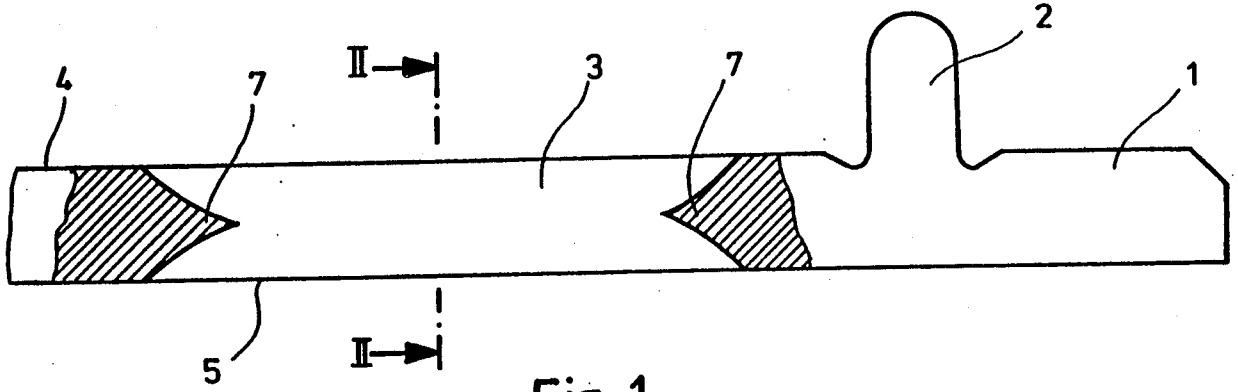
FIG. 1 is a side view in section, partially broken open, seen along line I—I of FIG. 2, of a knitting tool according to the invention in an embodiment incorporating a solid shank shown before being filled with vibration damping material (plastic).

Of the knitting tool shown in two different embodiments in FIGS. 1 and 5, which is stamped out of a steel band, shank 1 is shown in both embodiments as having a shaped-on butt 2. The knitting tool is, for example, a latch needle whose throat and head portion (not shown) is configured in a known manner.

Figure 3:
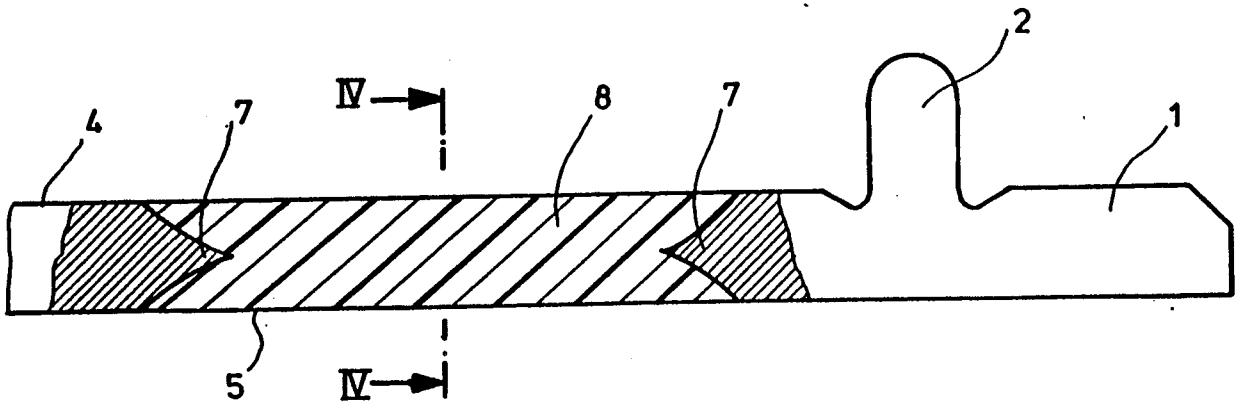
FIG. 3 is a sectional view of the knitting tool of FIG. 1, partially broken open and seen along line III—III of FIG. 4, with the vibration damping material (plastic) filling in place.

In the first embodiment shown in FIGS. 1 to 4, shank 1 is configured as a so-called full shank. In the region in front of butt 2, shank 1 is provided with at least one slot-like recess 3 which extends in the longitudinal direction of the shank and is limited to the shank region shown in FIG. 1. Slot-like recess 3 extends from the upper edge 4 of the shank to the lower edge (shank back) 5 thereof and is symmetrical to the longitudinal center plane of shank 1 shown in FIG. 2 at 6 and, as can be seen in FIGS. 1 and 3, has been milled by means of suitable slot cutters, starting from the upper edge 4 of the shank and from the lower edge 5 of the shank. Thus, at opposite ends the recess 3 is bounded by wedge-shaped projections 7 extending into the hollow spac formed in shank 1 by recess 3.

Figure 2:
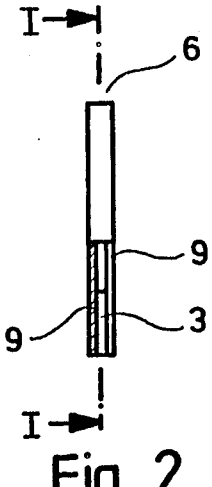
FIG. 2 is a sectional view of the knitting tool of FIG. 1, seen along line II—II of FIG. 1.
Figure 4:
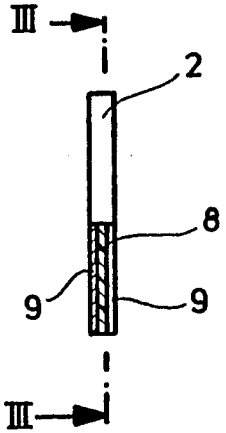
FIG. 4 is a sectional view of the knitting tool of FIG. 3, seen along line IV—IV of FIG. 3.

As shown in FIGS. 3 and 4, the hollow space defined by the recess 3 is completely filled with a vibration damping plastic material 8 which is flush with upper shank edge 4 and with lower shank edge 5 and is firmly bonded to the shank material delimiting the hollow space. The remaining cheeks 9 which define the broadsides of the hollow space formed by the slot-like recess 3 are relatively thin so that a high elastic flexibility results for shank 1 which is damped by the plastic material 8.

FIGS. 1 and 3 show only a single slot-like recess 3. Embodiments are contemplated in which a plurality of such recesses 3 are provided in front of and behind the butt 2. In certain cases, it may also be advisable not to allow the slot-like recess 3 extend from the upper shank edge 4 to the lower shank edge 5, but to permit it to extend only to a certain depth which is less than the height of the shank, so that the slot-like recess 3 forms a hollow space which is closed at the bottom and which is to be filled with the vibration damping material (plastic) 8 or 80.

In the second embodiment, shown in FIGS. 5 to 8, shank 1' is provided with guide members 10, 11, 12 which extend from the upper shank edge 4' to the lower shank edge 5', and are connected with one another by means of two parallel facing narrow bridge pieces 13, 14. Bridge piece 13 lies at the upper shank edge 4', and bridge piece 14 lies at the lower shank edge 5'.

Bridge pieces 13, 14 whose height is preferably no more than 1.1 mm and which are generally longer than 8 mm, define, together with guide members 10, 11, and 10, 12, respectively, an elongated opening 15 or 16, respectively, which is closed at its edges and is filled with vibration damping plastic material 80. The latter is firmly bonded at its edges to the edges of elongated opening 15 or 16, respectively and it completely fills the hollow space formed by the elongated opening.

In this embodiment, two slot-like recesses 30 are made in shank 1' in the region of the two openings 15 and 16, both recesses extending in the longitudinal direction of the shank and being arranged symmetrically to its longitudinal center plane 6' (FIG. 6). The two slot-like recesses 30 penetrate upper bridge pieces 13 and extend through lower bridge pieces 14 without exiting from shank 1' in the region of its lower edge 5'. Their outlines are shown in dashed lines in FIG. 5 and their precise shape can be seen in FIG. 7. Slot-like recesses 30 are filled with vibration damping material (plastic) 80 which continues as the plastic filling in openings 15 and 16. As can be seen in FIG. 7, the slot-like recesses are profiled at their end faces so that the wedge-shaped regions 7' projecting into the hollow spaces of recesses 30, as well as undercut regions 17 are formed, resulting in a form locking anchoring of the entire vibration damping material 80.

As an alternative, at least one of the slot-like recesses 30 may also extend through the lower bridge piece 14 and thus be open in the region of bottom shank edge 5'. Each one of the slot-like recesses 30 extends essentially over the entire length of the bridge piece 13 that it penetrates. Each recess 30 is cut into shank 1' by means of a slot cutter and is thus given a circular curvature, at least in part of its lateral edge region.

A typical shank thickness for the described knitting tool is about 0.4 mm. The width of the slot-like recesses 3 or 30, respectively, in each preferred embodiment is about one-third of the shank thickness, although other width-to-thickness ratios are also contemplated. A polyamide is particularly suitable for the vibration damping material 8 and 80.

It will be understood that the above description of the present invention is susceptible to various modifications, changes, and adaptations, and the same are intended to be comprehended within the meaning and range of equivalents of the appended claims.

What is claimed is:

1. In a stamped knitting tool for textile machines, said tool including a shank having upper and lower edges, at least one butt extending from said upper edge of said shank, and at least one hollow space filled with a vibration damping-material and being bonded to said shank, the improvement wherein:

said shank is provided with an upwardly opening slot-like recess beginning at said upper shank edge and extending in a longitudinal direction of said shank so as to form said hollow space, said slot-like recess having a top and a bottom and being bounded, at ends thereof and at lateral sides thereof, by said shank.

2. The improvement as defined in claim 1, wherein said hollow space formed by said slot-like recess is at least along one part of a length thereof, through-going from said upper shank edge to said lower shank edge.

3. The improvement as defined in claim 1, wherein said hollow space formed by said slot-like recess is closed at the bottom.

4. In a stamped knitting tool for textile machines, said tool including a shank having upper and lower longitudinal edgse, at least one butt extending from said upper edge; said shank having two spaced consecutive length portions constituting guide members; said guide members being connected, along said upper and lower longitudinal edges, by upper and lower bridge pieces; said guide members and said bridge pieces together define a hollow space to be filled with a vibration damping material; the improvement comprising a slot-like recess in one of said bridge pieces and beginning at said upper shank edge; said slot-like recess being in communication with said hollow space, being bounded at ends and lateral sides thereof, by said shank, and being filled with said material.

5. In a stamped knitting tool for textile machines, said tool including a shank having upper and lower edges, at least one butt extending from said upper edge of said shank, and at least one hollow spaced filled with a vibration damping-material and being bonded to said shank, the improvement wherein:

said shank is provided with a downwardly opening slot-like recess beginning at said lower shank edge and extending in a longitudinal direction of said shank so as to form said hollow space, said slot-like recess being bounded, at ends thereof and at lateral sides thereof, by said shank.

* * * * *